US008443607B2

(12) United States Patent
York et al.

(10) Patent No.: US 8,443,607 B2
(45) Date of Patent: May 21, 2013

(54) COAXIAL FUEL AND AIR PREMIXER FOR A GAS TURBINE COMBUSTOR

(75) Inventors: William D. York, Greer, SC (US); Willy S. Ziminsky, Simpsonville, SC (US); Benjamin P. Lacy, Greer, SC (US)

(73) Assignee: General Electric Company, Schenectady, NY (US)

( * ) Notice: Subject to any disclaimer, the term of this patent is extended or adjusted under 35 U.S.C. 154(b) by 783 days.

(21) Appl. No.: 12/389,994

(22) Filed: Feb. 20, 2009

(65) Prior Publication Data

US 2010/0212322 A1 Aug. 26, 2010

(51) Int. Cl.
*F02C 3/22* (2006.01)
*F02C 7/22* (2006.01)

(52) U.S. Cl.
USPC ..... 60/737; 60/740; 60/742; 60/738; 60/39.465

(58) Field of Classification Search
USPC ..... 60/738, 748, 772, 742, 740, 737, 60/776, 39.465
See application file for complete search history.

(56) References Cited

U.S. PATENT DOCUMENTS

| | | | | |
|---|---|---|---|---|
| 3,498,727 | A | 3/1970 | Martin, Jr. et al. | |
| 3,584,967 | A | 6/1971 | Zerlauth | |
| 3,592,557 | A | 7/1971 | Haas et al. | |
| 3,628,884 | A | 12/1971 | Mierley, Sr. | |
| 3,754,833 | A | 8/1973 | Remberg | |
| 3,980,233 | A * | 9/1976 | Simmons et al. | 239/400 |
| 4,078,377 | A | 3/1978 | Owens et al. | |
| 4,112,582 | A | 9/1978 | Beckershoff | |
| 4,286,921 | A | 9/1981 | Donlan et al. | |
| 4,650,396 | A | 3/1987 | Schwarz | |
| 4,890,978 | A | 1/1990 | McLaurin et al. | |
| 5,141,394 | A | 8/1992 | Donlan | |
| 5,671,597 | A | 9/1997 | Butler et al. | |
| 5,921,749 | A | 7/1999 | McLaurin et al. | |
| 6,056,538 | A * | 5/2000 | Buchner et al. | 431/115 |
| 6,082,963 | A | 7/2000 | Sexton et al. | |
| 6,192,688 | B1 | 2/2001 | Beebe | |
| 6,438,961 | B2 | 8/2002 | Tuthill et al. | |
| 6,457,963 | B1 | 10/2002 | Tawara et al. | |
| 6,615,574 | B1 | 9/2003 | Marks | |
| 6,640,545 | B2 | 11/2003 | Ruck et al. | |
| 6,993,916 | B2 | 2/2006 | Johnson et al. | |
| 7,007,477 | B2 | 3/2006 | Widener | |
| 2004/0050057 | A1 | 3/2004 | Bland et al. | |
| 2005/0039456 | A1 * | 2/2005 | Hayashi | 60/737 |
| 2005/0247065 | A1 | 11/2005 | Dudebout et al. | |
| 2006/0021350 | A1 * | 2/2006 | Sanders | 60/743 |

(Continued)

*Primary Examiner* — William H Rodriguez
*Assistant Examiner* — Steven Sutherland
(74) *Attorney, Agent, or Firm* — Sutherland Asbill & Brennan LLP

(57) ABSTRACT

An air/fuel premixer comprising a peripheral wall defining a mixing chamber, a nozzle disposed at least partially within the peripheral wall comprising an outer annular wall spaced from the peripheral wall so as to define an outer air passage between the peripheral wall and the outer annular wall, an inner annular wall disposed at least partially within and spaced from the outer annular wall, so as to define an inner air passage, and at least one fuel gas annulus between the outer annular wall and the inner annular wall, the at least one fuel gas annulus defining at least one fuel gas passage, at least one air inlet for introducing air through the inner air passage and the outer air passage to the mixing chamber, and at least one fuel inlet for injecting fuel through the fuel gas passage to the mixing chamber to form an air/fuel mixture.

20 Claims, 11 Drawing Sheets

U.S. PATENT DOCUMENTS

2006/0260316 A1 11/2006 Stuttaford
2006/0266046 A1* 11/2006 Bonzani et al. ..... 60/746
2007/0130954 A1 6/2007 Lynch et al.
2008/0044782 A1 2/2008 Kostlin et al.

* cited by examiner

COAXIAL FUEL AND AIR PREMIXER FOR A GAS TURBINE COMBUSTOR

STATEMENT REGARDING FEDERALLY SPONSORED RESEARCH DEVELOPMENT

This invention was made with Government support under Contract No. DE-FC26-05NT42643 awarded by the United States Department of Energy. The Government has certain rights in the invention.

TECHNICAL FIELD

The present invention relates to gas turbines and, in particular, to an air/fuel premixer for a gas turbine suitable for, but not limited to, use with hydrogen containing fuels.

BACKGROUND OF THE INVENTION

Gas turbine engines mix compressed air with fuel for ignition in a combustor to generate combustion gases from which energy and power are generated. The typical air pollutants produced by gas turbines burning conventional hydrocarbon fuels are nitrogen oxides (NOx), carbon monoxide (CO), and unburned hydrocarbons. It is known in the art that the rate of NOx formation is exponentially dependent on temperature, which, in turn, correlates to the fuel-air ratio of the mixture fed into the combustion chamber. To reduce the pollutant emissions, fuel and air are premixed to a lean mixture prior to combustion.

Recently, gas turbines are starting to use coal-derived synthesis gas ("syngas") as a means to convert coal into power with lower pollutant emissions than traditional coal plants. Some syngas fuels, such as ones containing large amounts of hydrogen, are highly reactive so that flame holding, autoignition, and flashback problems are more likely to occur in the premixer, consequently degrading emissions performance and causing hardware damage due to overheating.

It is known in the prior art that recirculation zones may occur in the premixer. For example, fuel injection into a crossflow of air often creates recirculation zones behind the fuel jets where the fuel participates in a secondary flow, causing the fuel to reside in this area much longer than outside of the area. For highly reactive fuels, high flame speeds and short blow-off times mean that flame holding is more likely to occur in the low-speed recirculation zones. Some premixers can reduce the tendency for flame holding for highly reactive fuels, but often at the expense of incurring large pressure drops in the premixer. Thus, there exists a need for an air/fuel premixer that can be used with highly reactive fuels without compromising turbine efficiency, functionality, or life cycle.

Objects and advantages of the invention will be set forth in part in the following description, or may be obvious from the description, or may be learned through practice of the invention. Unless otherwise defined, all technical and scientific terms and abbreviations used herein have the same meaning as commonly understood by one of ordinary skill in the art to which this invention pertains. Although methods and compositions similar or equivalent to those described herein can be used in the practice of the present invention, suitable methods and compositions are described without intending that any such methods and compositions limit the invention herein.

DETAILED DESCRIPTION OF THE INVENTION

The embodiments of the present invention encompass a gas turbine combustor comprising an air/fuel premixer, which is suitable for, but not limited to, use with highly reactive fuels. The air/fuel premixer of the present invention may be used with any gas fuel including, but not limited to, natural gas, syngas, carbon-free syngas, and high-hydrogen content gas.

Figure 1A:
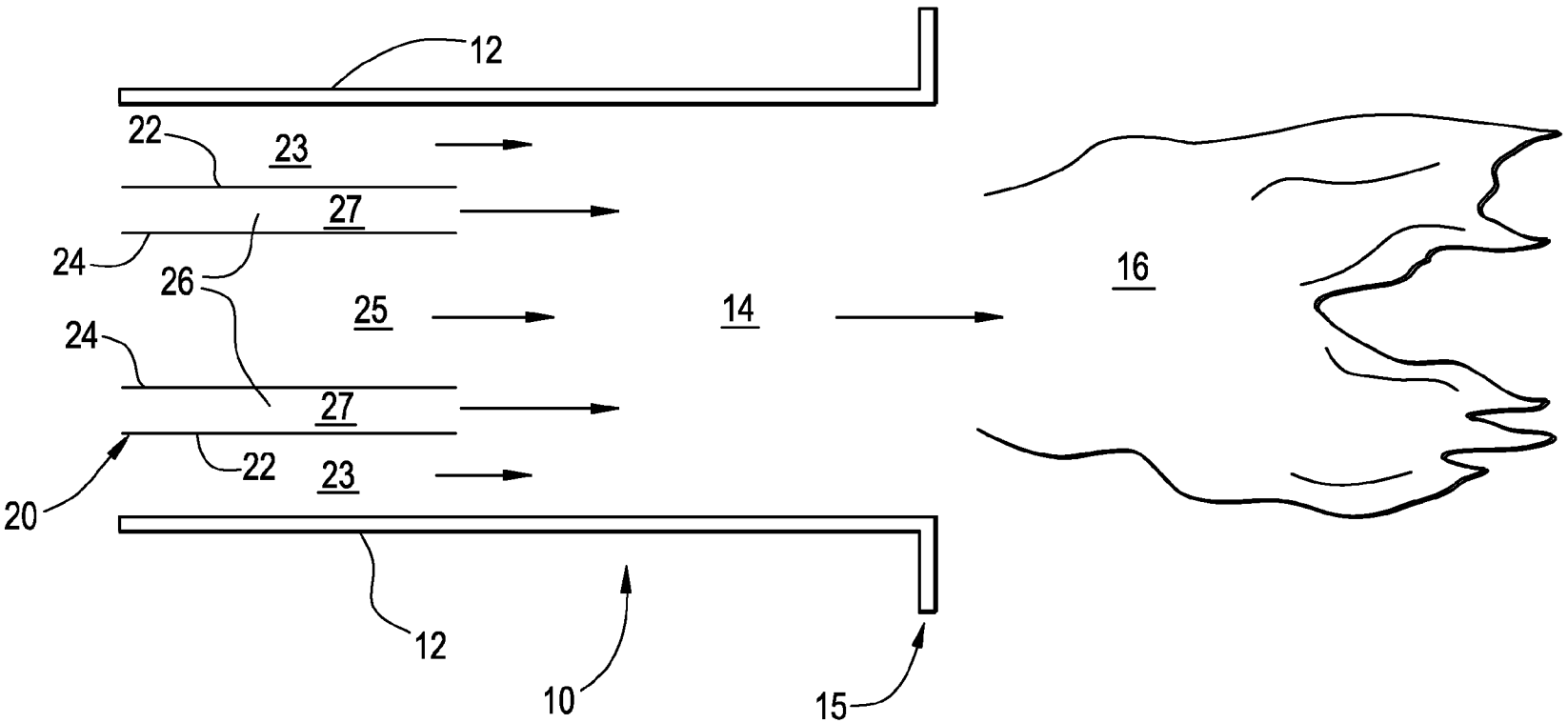
FIG. 1*a* is an axial schematic view.
Figure 1B:
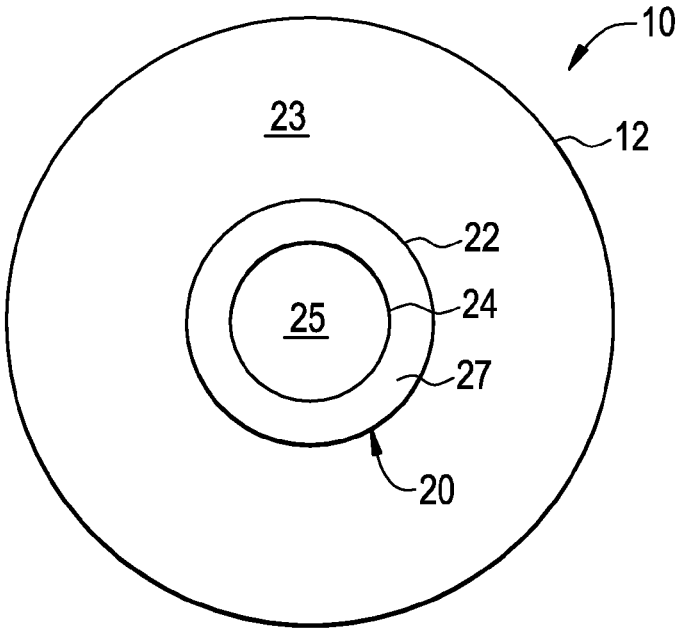
FIG. 1*b* is a cross-sectional view.
Figure 1C:
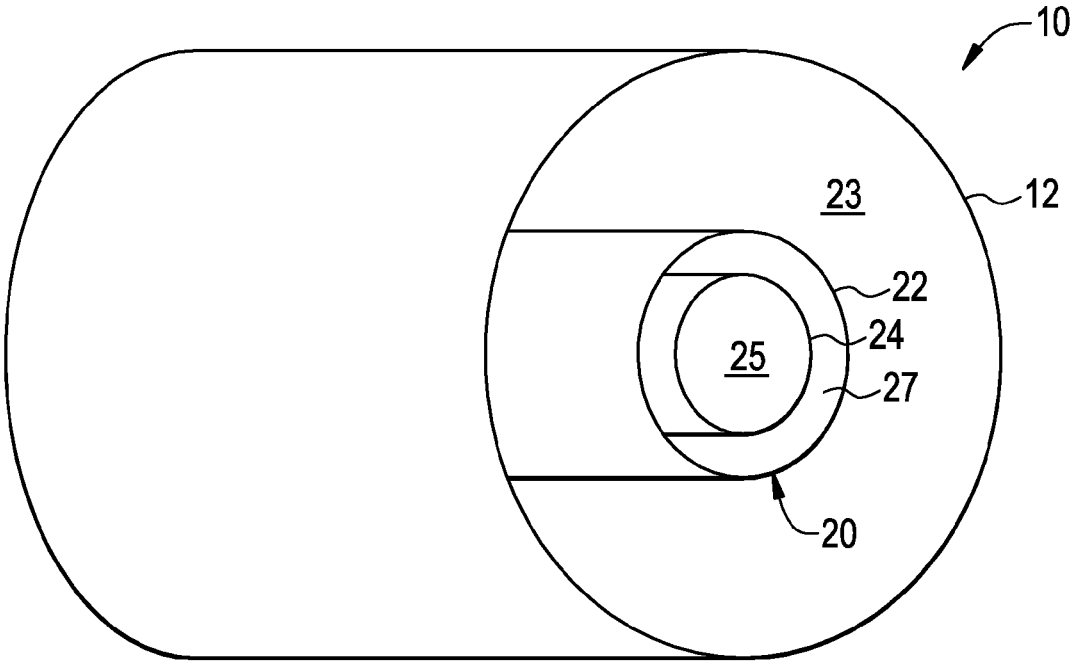
FIG. 1*c* is an isometric view of an embodiment of a co-axial annular air/fuel premixer.

FIGS. 1*a*, 1*b*, and 1*c* illustrates a particular embodiment of an air/fuel premixer for use in the combustion system of a gas turbine. The air/fuel premixer 10 comprises a peripheral wall 12 defining a mixing chamber 14, a nozzle 20 disposed at least partially within the peripheral wall 12, wherein the nozzle 20 comprises at least one annular fuel gas passage 27, and at least one fuel inlet (not shown) for injecting fuel through the fuel gas passage 27 to the mixing chamber 14.

In a particular embodiment, the nozzle 20 comprises an outer annular wall 22 spaced from the peripheral wall 12, so as to define an outer annular air passage 23 between the peripheral wall 12 and the outer annular wall 22. In a more particular embodiment, the fuel gas passage 27 is defined inside the outer annular wall 22. In another embodiment, the nozzle 20 further comprises an inner annular wall 24 disposed at least partially within and spaced from the outer annular wall 22, so as to define an inner air passage 25, and at least one fuel gas annulus 26 between the outer annular wall 22 and the inner annular wall 24, the at least one fuel gas annulus 26 defining the at least one fuel gas passage 27. In a more particular embodiment, the air/fuel premixer 10 comprises at least one air inlet (not shown) for introducing air through the inner air passage 25 and the outer air passage 23 to the mixing chamber 14.

Once air enters the air/fuel premixer 10 through the at least one air inlet, the air stream passes through the inner air passage 25 and/or the outer air passage 23 to enter the mixing chamber 14. The fuel stream enters through at least one fuel inlet (not shown) and passes through the fuel gas passage 27 to enter the mixing chamber 14 to form an air/fuel mixture. As used herein, the term "air stream(s)" will be used to refer to the fluid flow in the inner air passage 25 and/or the outer air passage 23. In a particular embodiment, the air and the fuel are introduced coaxially. In another embodiment, the fuel stream flows in the fuel gas passage 27 in substantially the same direction as the air stream(s) flowing in the outer air passage 23 and/or the inner air passage 25. In yet another embodiment, the fuel stream enters the mixing chamber 14 between the air stream(s) in substantially the same direction as the flow of the air stream(s). Increasing the contact area between the fuel stream and the air stream(s) may facilitate mixing in the mixing chamber 14.

In one embodiment, the air stream(s) are fully oriented in the axial direction and uniformly distributed across the outer air passage 23 and/or the inner air passage 25 before entering the mixing chamber 14. In another embodiment, the at least one air inlet is located sufficiently upstream of the mixing chamber 14 for the air stream(s) to be fully oriented in the axial direction before entering the mixing chamber 14. In yet another embodiment, the nozzle 20 is sufficiently long for the air stream(s) to reach a substantially uniform distribution across the outer air passage 23 and/or the inner air passage 25 before entering the mixing chamber 14. Those of ordinary skill in the art would readily determine the length of the nozzle 20 based on factors including, but not limited to, the velocity of the air streams, the size of the outer air passage 23 and the inner air passage 25, and the geometric characteristics of the air inlets. In a more particular embodiment, the nozzle 20 is at least fifty percent of the total length of the premixer from the air inlet to fuel/air mixture exit 15. In another embodiment, the cross-sectional areas of the inner air passage 25 and outer air passage 23 are within forty percent of each other. This may be done by, but is not limited to, adjusting the diameter of the outer peripheral wall 12 and/or by adjusting the inner and outer diameters of the nozzle 20.

The air/fuel mixture exits the discharge end 15 of the mixing chamber 14 to enter the combustion chamber 16. In one embodiment, the mixing chamber 14 is sufficiently long for the fuel concentration in the fuel/air mixture to reach substantial uniformity prior to exiting into the larger combustion chamber 16. Those of ordinary skill in the art would readily determine the length of the mixing chamber 14 considering factors including, but not limited to, the type of fuel, the cost of the premixer, the pressure drop through the premixer, the turbine efficiency, and the desired level of emissions for NOx, CO, and other pollutants. In yet another embodiment, the cross-sectional area of the combustion chamber 16 is at least fifty percent larger than the cross-sectional area of the mixing chamber 14 to permit flame stabilization in the combustion chamber 16. In one embodiment, the air stream(s) and the fuel stream travel at velocities greater than the local flame speed so that burning only occurs when the air/fuel mixture reaches the combustion chamber 16, which is in connection with the mixing chamber 14.

Materials and construction methods may cause tiny wake zones or recirculation zones in the premixer in areas where flame holding is more likely to occur. For example, a small recirculation zone may occur in the wake region substantially immediately aft of the end of the fuel annulus walls, which have a finite thickness. An ignition event near such areas is more likely to cause flame holding inside the premixer, which is an undesirable event.

Figure 2:
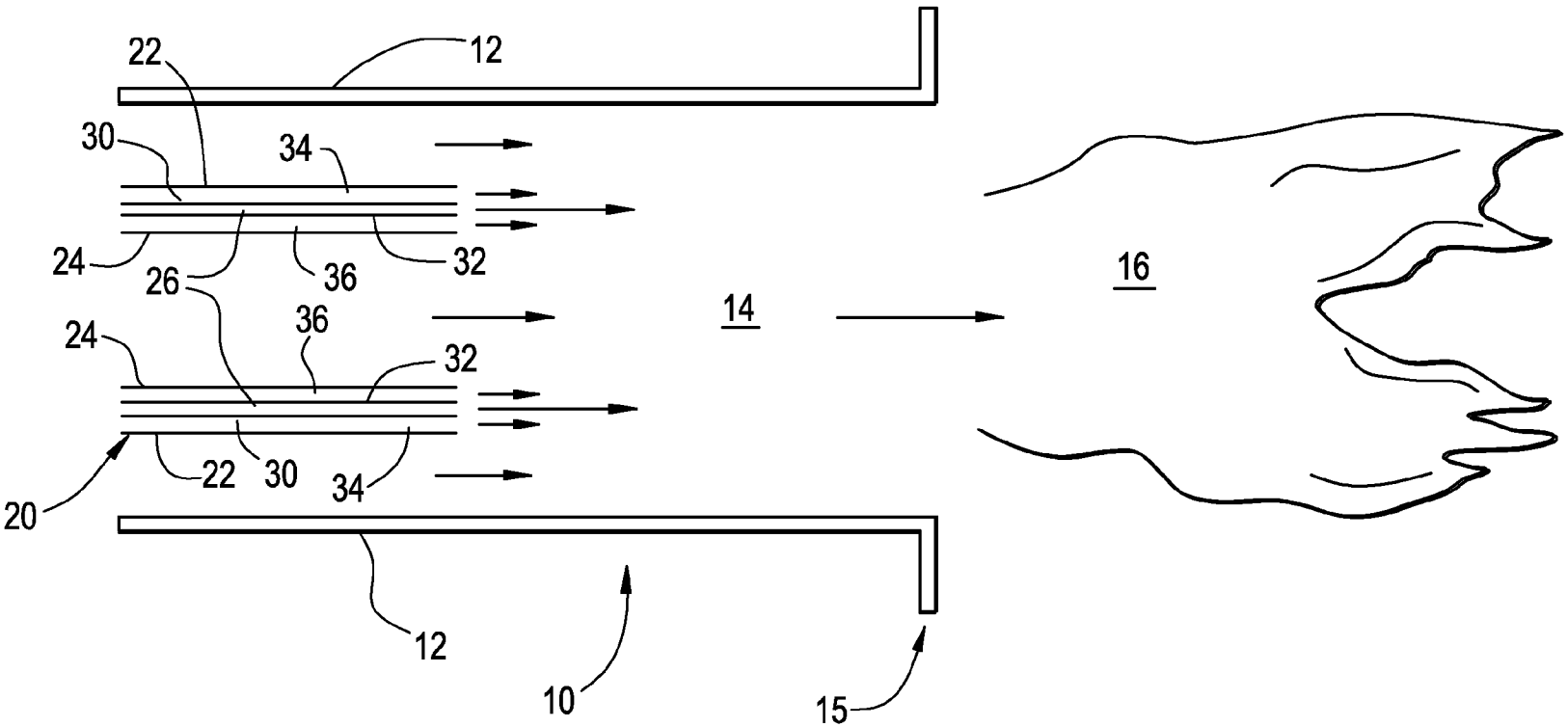
FIG. 2 is an axial schematic view of an embodiment of the air/fuel premixer with inert gas streams.
Figure 3:
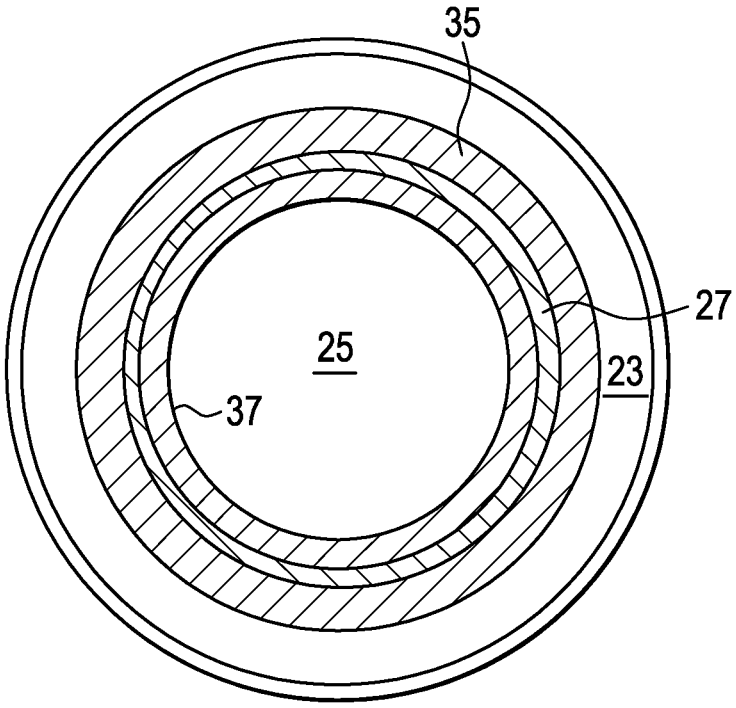
FIG. 3 is a cross-sectional view of an embodiment of the air/fuel premixer with inert gas streams.

Referring to FIGS. 2 and 3, in one embodiment of the invention, the nozzle 20 comprises a third annular wall 30 disposed at least partially between and spaced from the outer annular wall 22 and the inner annular wall 24, so as to define at least one inert annulus, the at least one inert annulus defining at least one inert gas passage adjacent to the fuel gas passage 27. In a more particular embodiment, the inert annulus terminates at or immediately upstream of the end of the fuel gas annulus 26. In still a more particular embodiment, the air/fuel premixer 10 comprises at least one inert gas inlet (not shown) for injecting inert gas through the inert gas passage. The inert gas stream may help to reduce or eliminate the mixing of the fuel stream and the air stream(s) in the wake zones to minimize flame holding in the premixer. Suitable inert gases include, but are not limited to, nitrogen, steam, and carbon dioxide. Those of ordinary skill in the art would know that multiple inert gas passages and fuel gas passages in different arrangements may be desirable depending on factors including, but not limited to, turbine efficiency and cost.

In a particular embodiment, the nozzle 20 further comprises a third annular wall 30 disposed at least partially between and spaced from the outer annular wall 22 and the inner annular wall 24, so as to define an outer inert annulus 34, the outer inert annulus 34 defining an outer inert gas passage 35 between the fuel gas passage 27 and the outer air passage 23, and a fourth annular wall 32 disposed at least partially between and spaced from the third annular wall 30 and the inner annular wall 24, so as to define an inner inert annulus 36, the inner inert annulus 36 defining an inner inert gas passage 37 between the fuel gas passage 27 and the inner air passage 25. In a more particular embodiment, the air/fuel premixer 10 comprises at least one inert gas inlet (not shown) for injecting inert gas through the outer inert passage 35 and the inner inert passage 37.

Figure 4:
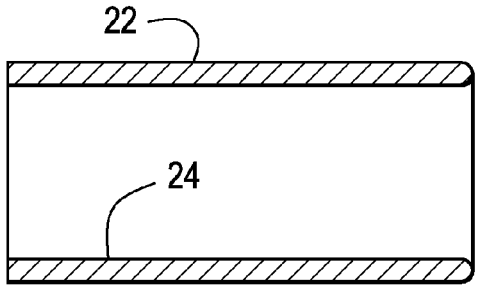
FIG. 4 is an enlarged view of an embodiment of the air/fuel premixer having the inner and outer annular walls with curved ends.
Figure 5:
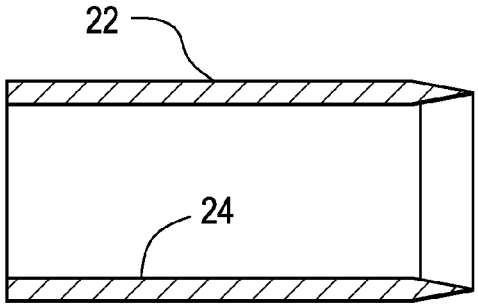
FIGS. 5 and 6 are enlarged views of embodiments of the air/fuel premixer having the inner and outer annular walls with sharp ends.
Figure 6:
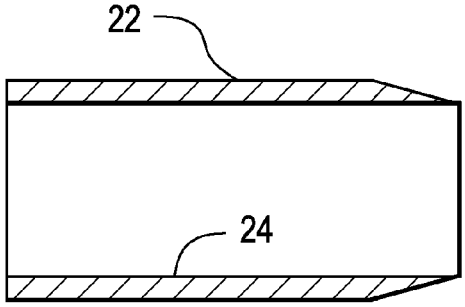
Figure 7:
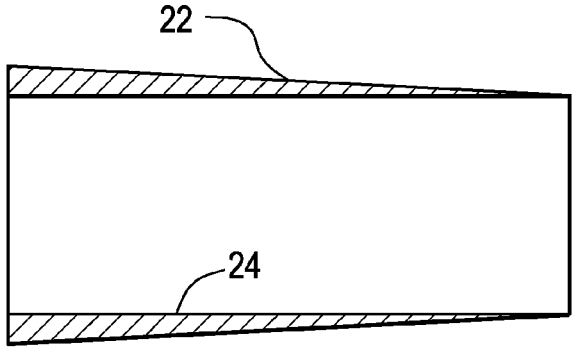
FIG. 7 is an enlarged view of an embodiment of the air/fuel premixer having the inner and outer annular walls of the nozzle with gradually declining wall thicknesses.
Figure 8A:
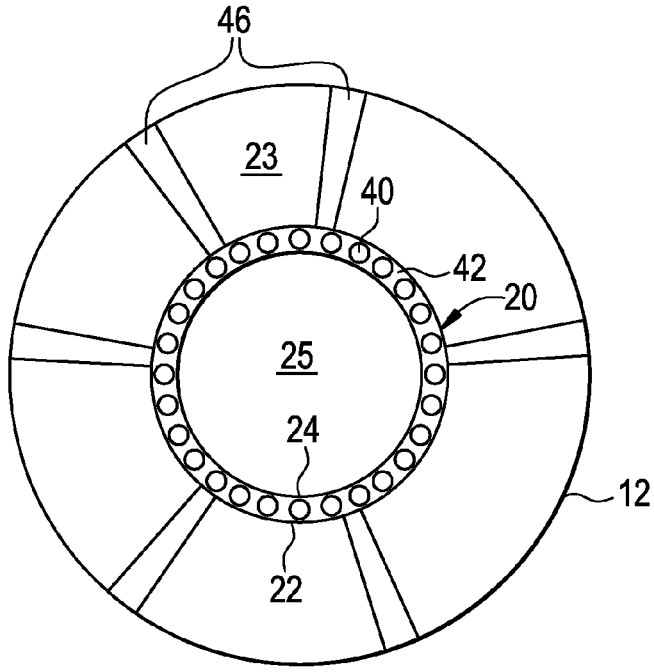
FIGS. 8*a* and 8*b* are cross-sectional views of the air/fuel premixer having discharge holes or a continuous discharge slit at the tip of the nozzle, respectively.
Figure 8B:
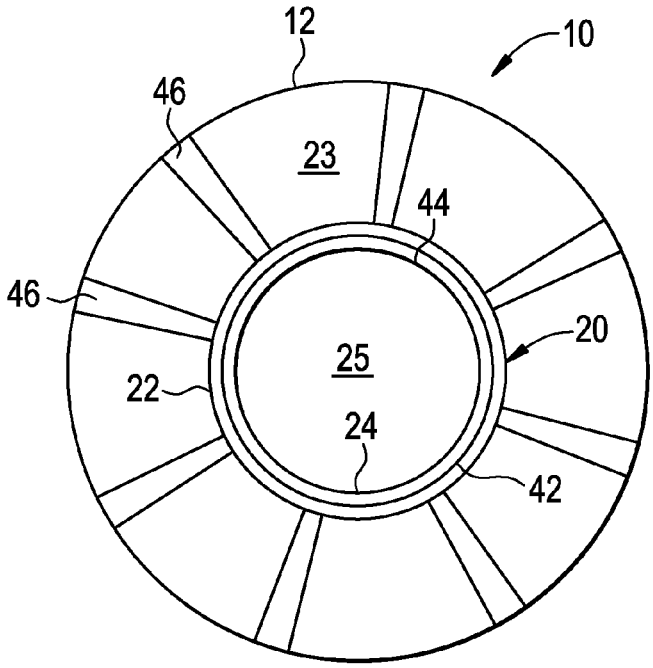

The physical structures of the premixer components, particularly the ends and edges, may be shaped to minimize the occurrence and size of wake zones and other low-velocity recirculation regions. In one embodiment, as illustrated in FIG. 4, the ends of the nozzle 20 may be aerodynamically curved. In another embodiment illustrated in FIGS. 5 and 6, the ends of the nozzle 20 may be sharpened to narrow edges. In yet another embodiment illustrated in FIG. 7, the outer annular wall 22 comprises walls with gradually decreasing thicknesses in the axial direction. In still some embodiments illustrated in FIGS. 8*a* and 8*b*, the downstream end of the nozzle 20 may include a plurality of discharge holes 40 at the tip 42 of the nozzle 20 or a continuous discharge slit 44 extending perimetrically around the tip 42 of the nozzle 20.

Figure 9A:
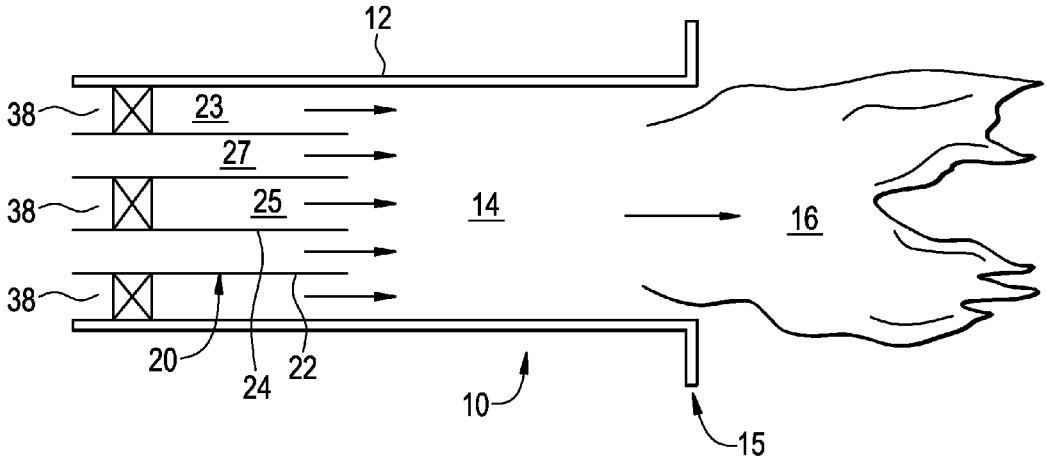
FIG. 9*a* is an axial schematic view and FIG. 9*b* is a cross-sectional view of an embodiment of the air/fuel premixer with swirl vanes.
Figure 9B:
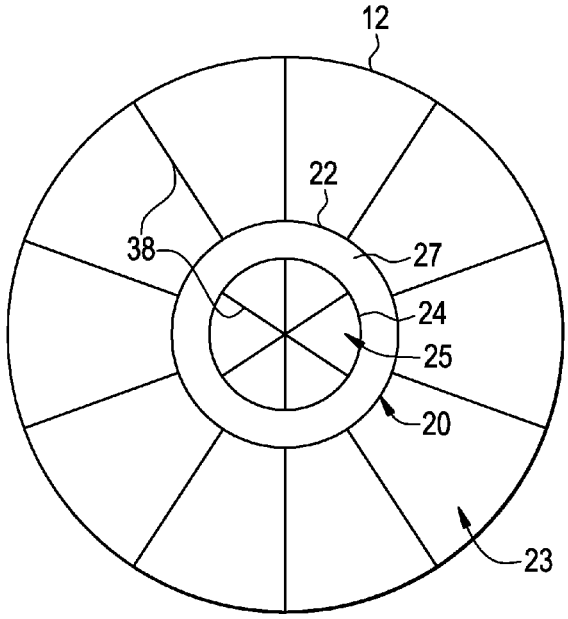

Different features may be used with or added to the present invention to improve the uniformity of the air/fuel mixture exiting the mixing chamber 14. In one embodiment, the air/fuel premixer 10 may comprise a turbulence-generating screen or a wire mesh downstream of the at least one air inlet and upstream of the where the fuel is injected into the mixing chamber 14. In another embodiment, the air/fuel premixer 10 may comprise a swirling means in one or more of the air stream(s) downstream of the at least one air inlet and upstream of where the fuel is injected into the mixing chamber 14. Non-limiting examples of swirling means include vanes or swirlers. The swirling means may be used to provide a more stable flame downstream and/or to enhance mixing of the fuel stream and the air stream(s) in the premixer. In one embodiment, illustrated in FIG. 9, swirl vanes 38 are provided in both the outer air stream 23 and inner air stream 25. In such embodiments, the swirl direction may be the same for both the inner and the outer air streams. Alternatively, the swirl imparted to the inner air stream 25 is in the opposite direction as the swirl imparted to the outer air stream 23.

Figure 10:
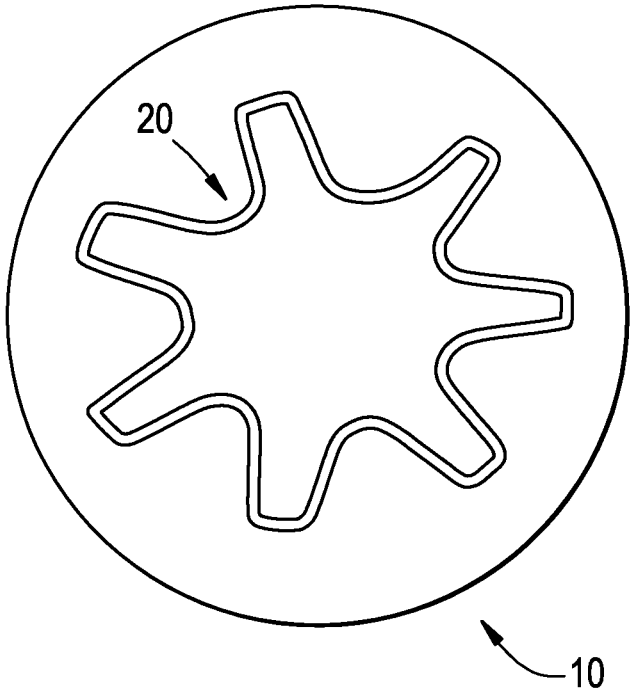
FIG. 10 is a cross-sectional view of an embodiment of the air/fuel premixer with a non-circular shaped nozzle.

In one embodiment, as illustrated in FIG. 10, the nozzle 20 may be non-circular shaped. In a more particular embodiment, the nozzle 20 comprises of at least one non-circular shaped annulus. Some non-circular shapes include, but are not limited to, elliptical, daisy-shaped, or otherwise-shaped.

Figure 11:
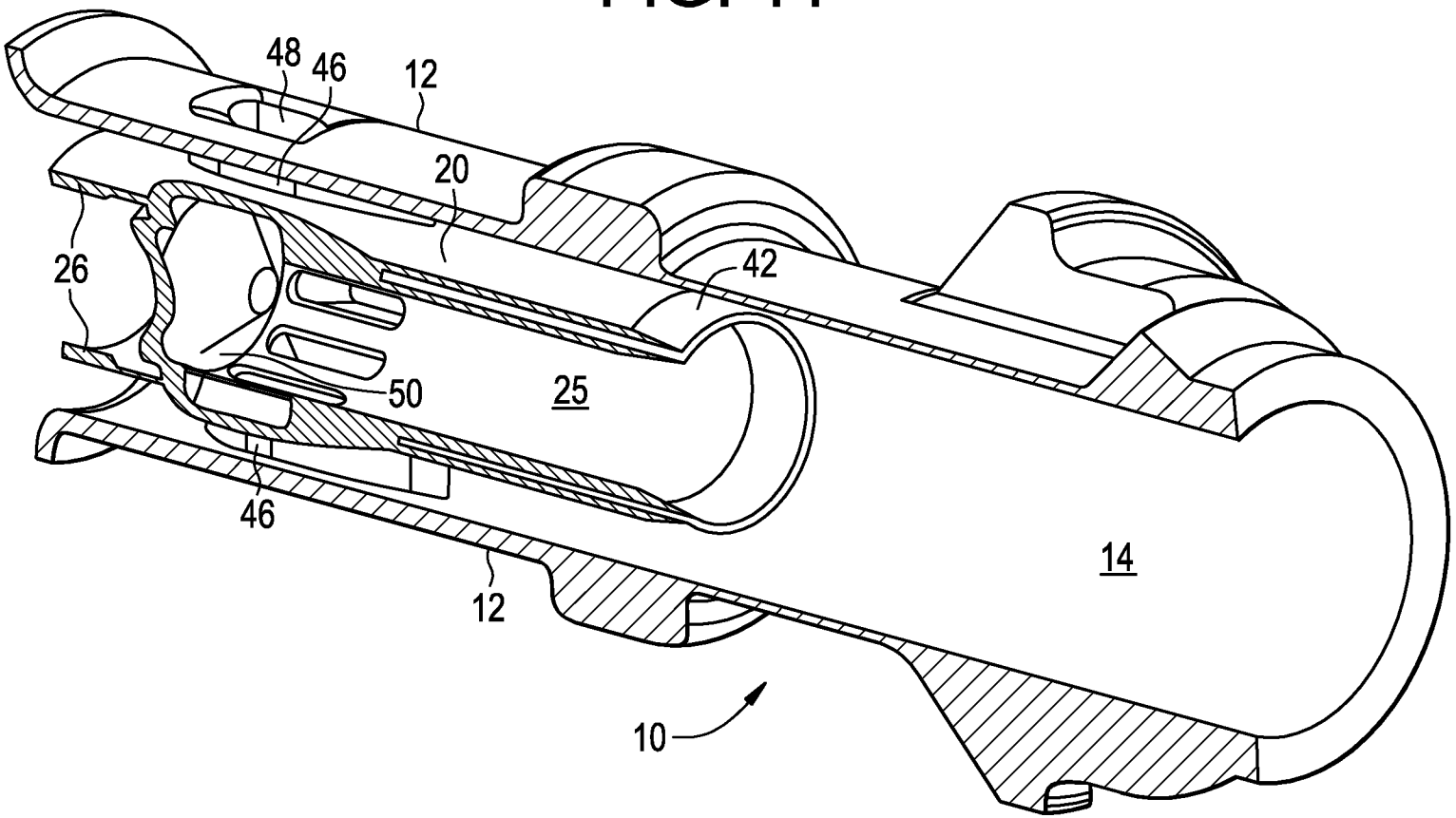
FIG. 11 is an isometric view of an embodiment of the air/fuel premixer.

In another embodiment, the nozzle 20 may be shaped without sharp edges. Increasing the circumference of the nozzle may increase the contact area between the fuel stream and the air stream(s), thus achieving a better initial fuel distribution over the cross-section of the mixing chamber 14 when the fuel stream enters the mixing chamber 14. In yet a more particular embodiment, the outer inert annulus 34 and the inner inert annulus 32 may be shaped corresponding to the shape of the fuel gas annulus 26. The foregoing embodiments may be made using any suitable design features known to those of skill in the art. Particular structural supports are described in more detail in the co-pending U.S. patent application Ser. No. 12/360,449 of the Assignee entitled "Annular Fuel and Air Co-Flow Premixer," the disclosure of which is incorporated by reference herein in its entirety. Briefly described and as illustrated in FIG. 11, a plurality of struts 46 may extend inwardly from the peripheral wall 12 to support the fuel gas annulus 26. Each strut may be hollow or may include at least one inlet air passage 48 that extends therethrough. The inlet air passage 48 may extend from the peripheral wall 12 exterior to inner air passage 25, thereby providing an inlet for the air to enter the inner air passage 25. A cap 50 may be disposed at the upstream end of the inner air passage 25, directing the air entering the inner air passage 25 downstream toward the mixing chamber 14. The plurality of struts 46 are positioned in such a way that they permit air to flow through the outer air passage 20 downstream past the plurality of struts 46 toward of the mixing chamber 14.

In embodiments, the struts 46 are disposed such that they are at a sufficient distance upstream of the mixing chamber 14 such that any flow disturbances caused by the struts 46 are dampened out before the air stream(s) reach the mixing chamber 14. In some embodiments, the struts 46 may have an aerodynamically streamlined shape to minimize flow disturbances in the air stream(s).

Figure 12:
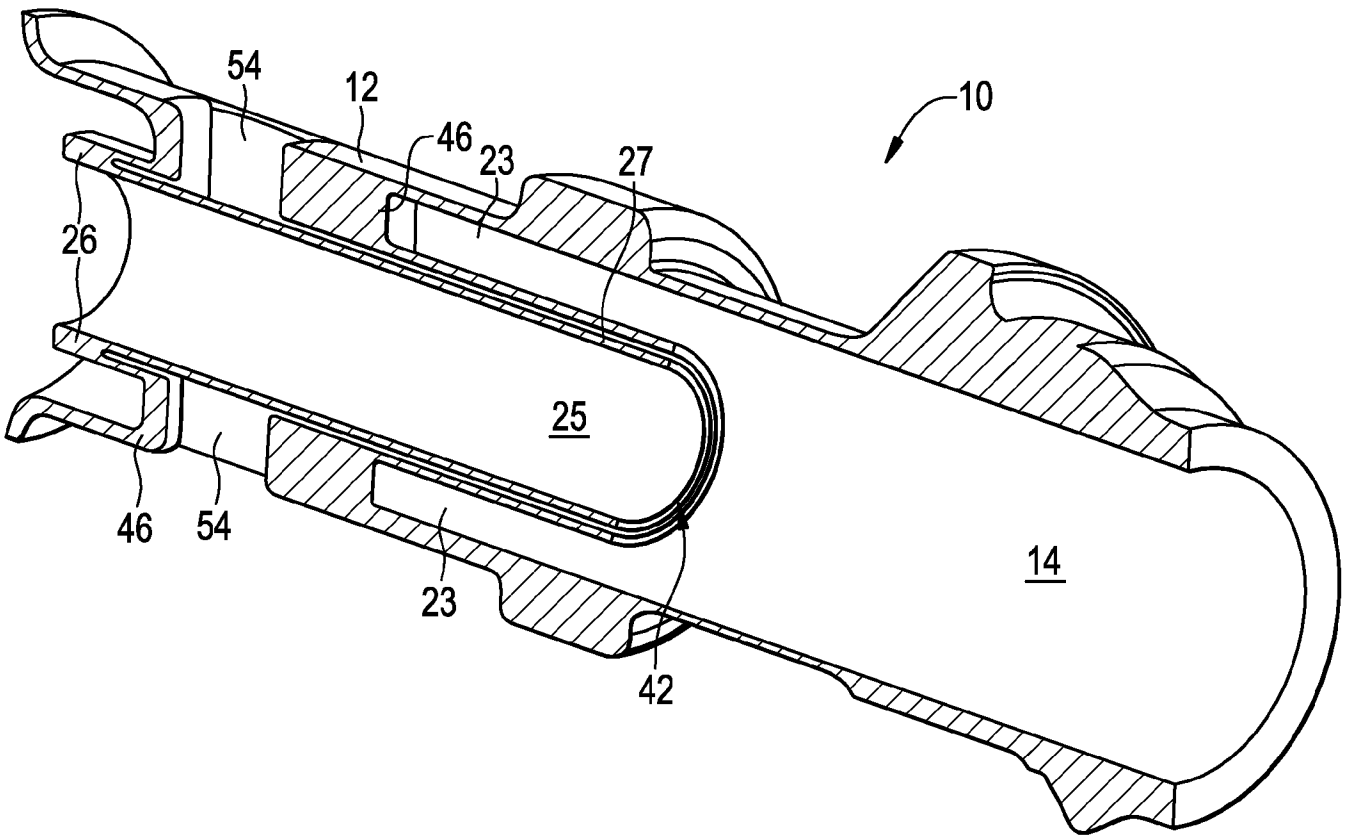
FIG. 12 is an isometric view of an embodiment of the air/fuel premixer.

In an embodiment illustrated in FIG. 12, the plurality of struts 46 include one or more fuel inlets 54 for providing fuel to the fuel gas passages 27. In this embodiment, the air stream(s) are open both upstream and downstream within the premixer 10, allowing the air to flow substantially axially through the premixer 10, thereby reducing flow disturbances.

Figure 13:
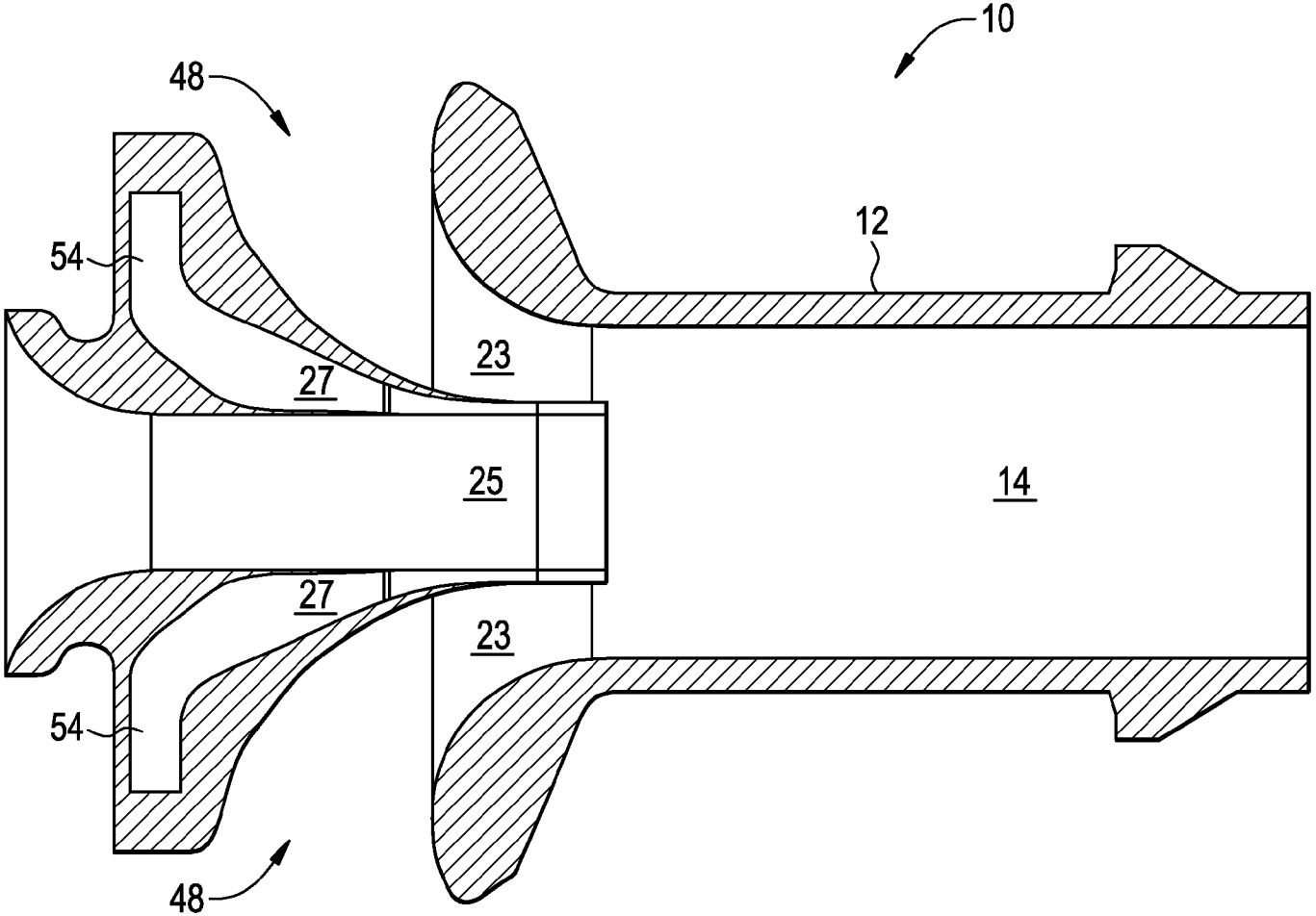
FIG. 13 is a cross-sectional view of an embodiment of the air/fuel premixer.

In yet another embodiment illustrated in FIG. 13, one or more air inlets 48 are disposed at the peripheral wall 12. In some embodiments, the one or more air inlets 48 are positioned such that the air stream enters the outer air passage 23 in a substantially radial direction. The outer air passage 23 may be curved from a radial direction to an axial direction, thereby reorienting the air stream from a radially-directed flow to an axial-directed flow upstream of the mixing chamber 14. Similarly, a plurality of fuel passage inlets 54 are disposed upstream of the one or more air inlets 48 to the outer air passage 23. The fuel passage inlets 54 direct the fuel downstream toward the mixing chamber 14. No struts are required in this embodiment because the fuel gas passage 27 does not cross the outer air passage 23. Such embodiments alleviate the potential flow disturbances caused by the struts, improving premixer and combustor operability.

Embodiments of the present invention also encompass a method of premixing fuel and air in an air/fuel premixer for the combustion system of a gas turbine, the method comprising: introducing air into an outer air passage 23 to form an outer air stream, introducing air into an inner air passage 25 to form an inner air stream, introducing fuel into a fuel gas passage 27 to form a fuel stream, flowing the incoming air coaxially as the incoming fuel, flowing the outer air stream and the inner air stream coaxially as the fuel stream, and thereafter, mixing the fuel stream, the outer air stream, and the inner air stream in a mixing chamber 14 to form an air/fuel mixture for injection into a combustion chamber 16.

In another embodiment, the method further comprises introducing an inert gas into an outer inert gas passage 35 to form an outer inert gas stream, introducing an inert gas into an inner inert gas passage 37 to form an inner inert gas stream, flowing the incoming inert gas coaxially as the incoming fuel, flowing the outer inert gas stream and the inner inert gas stream coaxially as the fuel stream, and injecting the inner and outer inert gas streams to the mixing chamber 14 at or immediately upstream of where the fuel stream enters the mixing chamber 14.

Multiple air/fuel premixers of the present invention may be used in each gas turbine combustor. Those of ordinary skill in the art would be able to determine the number and size of the premixers and the combustors based on factors including, but not limited to, target velocities, pressure drop, turbine performance, and turbine size.

It should be understood that the foregoing relates to a particular embodiment of the present invention, and that numerous changes may be made therein without departing from the scope of the invention as defined from the following claims.

The invention claimed is:

1. An air/fuel premixer comprising:

a peripheral wall defining a mixing chamber;

a nozzle disposed at least partially within the peripheral wall comprising an outer annular wall spaced from the peripheral wall, so as to define an outer air passage between the peripheral wall and the outer annular wall, an inner annular wall disposed at least partially within and spaced from the outer annular wall, so as to define an inner air passage, and at least one fuel gas annulus between the outer annular wall and the inner annular wall, the at least one fuel gas annulus defining at least one fuel gas passage;

at least one air inlet for introducing air through the inner air passage and the outer air passage to the mixing chamber; and at least one fuel inlet for injecting gaseous fuel through the fuel gas passage to the mixing chamber to form an air/fuel mixture, wherein the at least one air inlet is located upstream of the mixing chamber such that the air introduced through the inner air passage and the outer air passage is axially oriented at the point it enters the mixing chamber.

2. The air/fuel premixer of claim 1, wherein the outer annular wall and the inner annular wall have outlet ends which are curved.

3. The air/fuel premixer of claim 1, wherein the outer annular wall and the inner annular wall have outlet ends which are sharpened to narrow edges.

4. The air/fuel premixer of claim 1, wherein the nozzle further comprises a third annular wall disposed at least partially between and spaced from the outer annular wall and the inner annular wall, so as to define at least one inert annulus, the at least one inert annulus defining at least one inert gas passage adjacent to the at least one fuel gas passage, wherein the at least one inert annulus terminates at or immediately upstream of the end of the at least one fuel gas annulus.

5. The air/fuel premixer of claim 1, wherein the nozzle further comprises:

a third annular wall disposed at least partially between and spaced from the outer annular wall and the inner annular wall, so as to define an outer inert annulus, the outer inert annulus defining an outer inert gas passage between the at least one fuel gas passage and the outer air passage; and a fourth annular wall disposed at least partially between and spaced from the third annular wall and the inner annular wall, so as to define an inner inert annulus, the inner inert annulus defining an inner inert gas passage between the at least one fuel gas passage and the inner air passage.

6. The air/fuel premixer of claim 1, wherein the nozzle is non-circular shaped.

7. The air/fuel premixer of claim 1, wherein the at least one fuel gas annulus is non-circular shaped.

8. A gas turbine combustor comprising:

at least one air/fuel premixer comprising a peripheral wall defining a mixing chamber, a nozzle disposed at least partially within the peripheral wall comprising an outer annular wall spaced from the peripheral wall, so as to define an outer air passage between the peripheral wall and the outer annular wall, an inner annular wall disposed at least partially within and spaced from the outer annular wall, so as to define an inner air passage, and at least one fuel gas annulus between the outer annular wall and the inner annular wall, the at least one fuel gas annulus defining at least one fuel gas passage;

at least one combustion chamber in connection with the mixing chamber;

at least one air inlet for introducing air through the inner air passage and the outer air passage to the mixing chamber; and at least one fuel inlet for injecting gaseous fuel through the fuel gas passage to the mixing chamber to form an air/fuel mixture for injection into the at least one combustion chamber, wherein the at least one air inlet is located upstream of the mixing chamber such that the air introduced through the inner air passage and the outer air passage is axially oriented at the point it enters the mixing chamber.

9. The gas turbine combustor of claim 8, wherein the outer annular wall and the inner annular wall have outlet ends which are curved or rounded.

10. The gas turbine combustor of claim 8, wherein the outer annular wall and the inner annular wall have outlet ends which are sharpened to narrow edges.

11. The gas turbine combustor of claim 8, wherein the nozzle further comprises a third annular wall disposed at least partially between and spaced from the outer annular wall and the inner annular wall, so as to define at least one inert annulus, the at least one inert annulus defining at least one inert gas passage adjacent to the at least one fuel gas passage, wherein the at least one inert annulus terminates at or immediately upstream of the end of the at least one fuel gas annulus.

12. The gas turbine combustor of claim 8, wherein the nozzle further comprises:

a third annular wall disposed at least partially between and spaced from the outer annular wall and the inner annular wall, so as to define an outer inert annulus, the outer inert annulus defining an outer inert gas passage between the at least one fuel gas passage and the outer air passage; and a fourth annular wall disposed at least partially between and spaced from the third annular wall and the inner annular wall, so as to define an inner inert annulus, the inner inert annulus defining an inner inert gas passage between the at least one fuel gas passage and the inner air passage.

13. The gas turbine combustor of claim 8, the premixer further comprising a swirling means downstream of the at least one air inlet.

14. The gas turbine combustor of claim 8, further comprising a turbulence-generating screen or mesh downstream of the at least one air inlet.

15. A method of premixing fuel and air in a premixer for a combustion system of a gas turbine, the premixer comprising a peripheral wall defining a mixing chamber, a nozzle disposed at least partially within the peripheral wall comprising an outer annular wall spaced from the peripheral wall, so as to define an outer air passage between the peripheral wall and the outer annular wall, an inner annular wall disposed at least partially within and spaced from the outer annular wall, so as to define an inner air passage, and at least one fuel gas annulus between the outer annular wall and the inner annular wall, the at least one fuel gas annulus defining at least one fuel gas passage, at least one air inlet, and at least one fuel inlet, the method comprising:

introducing air into the outer air passage to form an outer air stream;

introducing air into the inner air passage to form an inner air stream;

introducing gaseous fuel into the fuel gas passage to form a fuel stream;

flowing the incoming air coaxially as the incoming gaseous fuel;

flowing the outer air stream and the inner air stream coaxially as the fuel stream; and thereafter, introducing the coaxially flowing fuel stream, outer air stream, and inner air stream in the mixing chamber to form an air/fuel mixture for injection into a combustion chamber in connection with the mixing chamber.

16. The method of claim 15, wherein the outer annular wall and the inner annular wall have outlet ends which are curved or rounded.

17. The method of claim 15, wherein the outer annular wall and the inner annular wall have outlet ends which are sharpened to narrow edges.

18. The method of claim 15, wherein the premixer further comprises at least one inert gas inlet and the nozzle further comprises a third annular wall disposed at least partially between and spaced from the outer annular wall and the inner annular wall, so as to define an outer inert annulus, the outer inert annulus defining an outer inert gas passage between the at least one fuel gas passage and the outer air passage, and a fourth annular wall disposed at least partially between and spaced from the third annular wall and the inner annular wall, so as to define an inner inert annulus, the inner inert annulus defining an inner inert gas passage between the at least one fuel gas passage and the inner air passage, the method further comprising:

introducing an inert gas into the outer inert gas passage to form an outer inert gas stream;

introducing an inert gas into the inner inert gas passage to form an inner inert gas stream;

flowing the incoming inert gas coaxially as the incoming fuel;

flowing the outer inert gas stream and the inner inert gas stream coaxially as the fuel stream; and injecting the inner and outer inert gas streams to the mixing chamber at or immediately upstream of where the fuel stream is injected into the mixing chamber.

19. The method of claim 15, the premixer further comprising a swirling means downstream of the at least one air inlet and upstream of where the fuel stream is injected into the mixing chamber.

20. The method of claim 15, wherein the at least one fuel gas annulus is circular, elliptical, or daisy-shaped.

* * * * *